United States Patent [19]

Shores

[11] 4,124,796

[45] Nov. 7, 1978

[54] EMISSION CONTROL CALCULATOR

[75] Inventor: Marvin W. Shores, Pomona, Calif.

[73] Assignee: General Dynamics Corporation, Pomona, Calif.

[21] Appl. No.: 750,747

[22] Filed: Dec. 15, 1976

[51] Int. Cl.[2] ..... G06C 3/00; G06C 1/02; G06C 27/00

[52] U.S. Cl. ..... 235/88 R; 235/70 A; 235/78 R

[58] Field of Search ..... 235/89 R, 85 R, 78, 235/88, 70 A, 70 R, 61 B, 69

[56] References Cited

U.S. PATENT DOCUMENTS

| | | | |
|---|---|---|---|
| 2,179,531 | 11/1939 | Trapnell | 235/89 R |
| 3,050,249 | 8/1962 | Awramik, Jr. et al. | 235/78 |
| 3,266,722 | 8/1966 | Hobbis | 235/70 R |
| 3,273,795 | 9/1966 | Evans | 235/89 R |
| 3,289,930 | 12/1966 | Widrewitz et al. | 235/88 |
| 3,405,868 | 10/1968 | Yin | 235/70 R |
| 3,635,398 | 1/1972 | Toni | 235/88 |
| 3,822,038 | 7/1974 | Olson | 235/88 |
| 3,923,243 | 12/1975 | Barron | 235/88 |

*Primary Examiner*—Stephen J. Tomsky
*Attorney, Agent, or Firm*—Henry M. Bissell; Edwin A. Oser; Edward B. Johnson

[57] ABSTRACT

An adjustable display having interworking parts whereby upon manipulation interference frequencies emitted from spurious harmonic and imaged electromagnetic radiators interfering with an intended or expected bracketed received frequency can be isolated and identified for later corrective action, such as elimination of the interference frequencies. A method for establishing emitted frequencies which might interfere with expected or intended targeted received frequencies in a receiver is also described and taught.

4 Claims, 7 Drawing Figures

EMISSION CONTROL CALCULATOR

The invention herein described was made in the course of or under a contract, or subcontract thereunder, with the U.S. Department of the Navy.

BACKGROUND OF THE INVENTION

1. Field of the Invention

This invention relates to superheterodyne (down-converter) receivers having spurious responses through harmonic relationships and images interfering with an expected received echo or frequency, including apparatus and methods for calculating the interference frequencies.

2. Description of the Prior Art

Radar receivers employing a superheterodyne design have long been used to extract from space, usually by way of an antenna, electromagnetic frequency energy. In the radar technique, frequencies are radiated or emitted by a transmitter, usually by the same antenna which receives the echo. The superheterodyne design is used extensively also in other receivers, such as radios, televisions, communication links and the like. In the superheterodyne design, frequency energy is emitted from the transmitter. A narrow band width or window is provided at a precise time offset from the transmission time, in order to receive the expected echo or return of the transmitter frequency. The receiver thus can bracket the intended or expected echo or return frequency, eliminating as much noise or undesired frequencies as possible. Such devices frequently utilize a mixer-oscillator circuit which allows for the narrow banding of the frequency response of the receiver. Such a frequency conversion technique enables a designer to narrow the frequency response bandwidth of the receiver. Other or spurious responses are introduced, however, because of harmonic relationships and images. Frequently such spurious responses can be suppressed by auxiliary filtering or bandpassing.

Certain receiver applications are not susceptible to such suppression techniques, however. In such circumstances, it is desirable to eliminate or to "turn off" the emitter which might be the source of the spurious signal received by the receiver, which signal might be coincidental with the intended echo or received signal.

It has long been desired to identify the interfering emitted frequencies quickly and accurately so that the emitter emitting the interfering frequencies might be effectively neutralized. Various apparatus and devices have been developed in the past to correct this problem. In this regard, attention is directed to Boothby, U.S. Letters Pat. No. 2,546,147. Such superheterodyne receiving systems affording electronic assistance in distinguishing and determining the intended received frequency from spurious signals are useful. It is desired to have more simple, more economical and power or electronically independent means for distinguishing such spurious, emitted interference frequencies by manually operated, passive devices.

SUMMARY OF THE INVENTION

Arrangements in accordance with the present invention are basically adjustable devices having interworking parts so that by interworking the parts, an operator can visually, quickly and simply determine those spurious, harmonic and image frequencies which might interfere with an intended or expected echo or received signal to be picked up by a receiver. The system is specifically adapted to those receivers employing a super heterodyne design or technique.

In accordance with one aspect of the invention, known potentially interfering emitted frequencies are identified and plotted on a frequency graduated scale device. An interworking, partially transparent device movable relative to the graduated scale is arranged so that those particular spurious responses or harmonic interferences and the like will be narrowed to a particular few in number. In one embodiment, a third relatively movable interworking device clearly identifying the intended or expected received frequency or echo, works in relation to the graduated scale and the partially transparent assembly so that the particular interference frequencies are instantly identified.

In accordance with another aspect of the invention, the frequency graduated scale device is arranged in a circular pattern, and is connected to the partially transparent device so as to be concentrically movable relative thereto. Potentially interfering emitted frequencies are identified on the circular graduated scale device. The partially transparent device is arranged so that those particular spurious responses and harmonic interferences and the like can be narrowed to a particular few in number and visualized when the graduated scale device and the transparent device are correctly positioned relative to each other.

The invention in its embodiments can be constructed so that an extremely wide range of frequencies can be accommodated for quickly manipulable calculations or constructed for a specific receiver system and frequency band so as to reduce the manually manipulable operation of the device for speedier or quicker calculation of the potentially interfering signals.

A method for quickly entering identified and potentially interfering frequencies on the graduated scale, quickly narrowing the number and range of the potentially interfering signals and then quickly determining the precise interference frequencies by a sequence of simple, efficient steps is provided. Variations of the method of instantly identifying the precise interfering frequencies are given also.

BRIEF DESCRIPTION OF THE DRAWINGS

A better understanding of the present invention may be had from a consideration of the following detailed description, taken in conjunction with the accompanying drawings, in which.

DESCRIPTION OF THE PREFERRED EMBODIMENT

Figure 1:
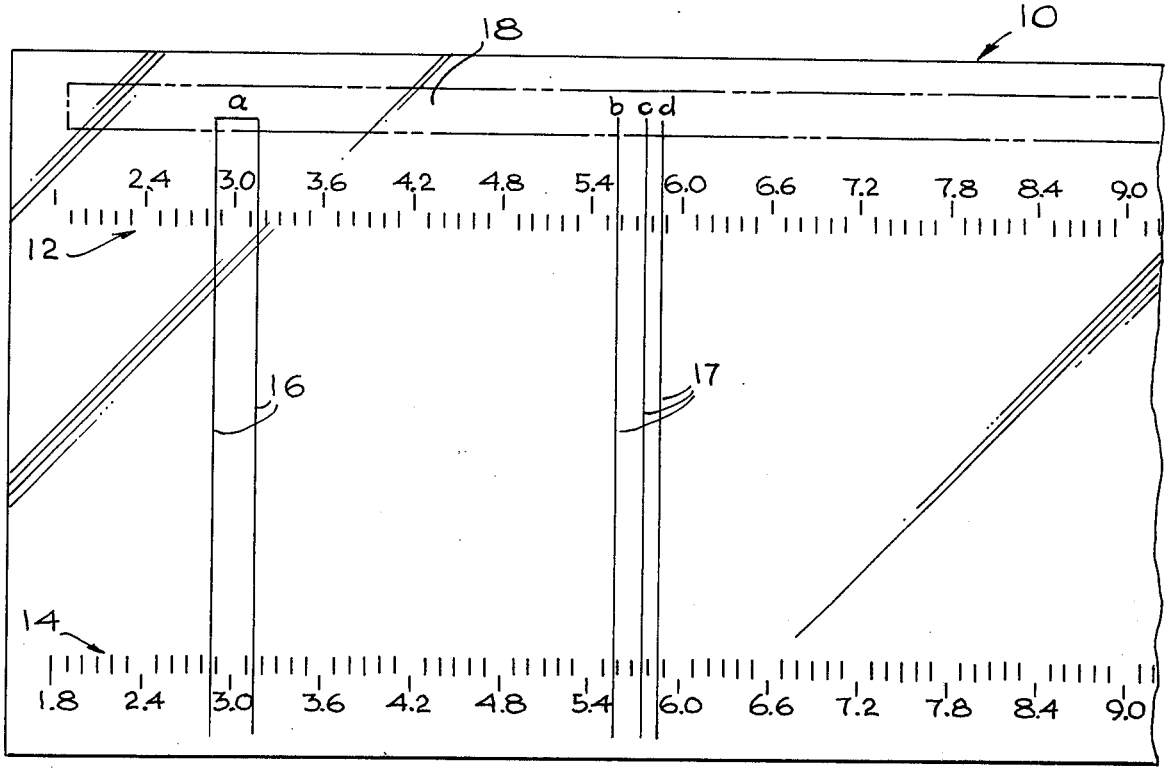
FIG. 1 illustrates one part of an embodiment of the invention.

FIG. 1 shows a graduated slide card 10 for use in arrangements in accordance with the present invention. Graduated slide 10 is shown having frequency graduations delineated horizontally along the scale, with the lower frequencies being on the left and progressing numerically to the right. Two graduated scales 12, 14 are shown, both horizontal and parallel to each other. Graduated scale 12 is aligned along the upper edge of the slide 10. Graduated scale 14, identical with graduated scale 12, is arranged at the lower edge of the slide 10. The slide card 10 may be constructed of paperboard, plastic or the like. Lines, such as lines 16 and 17, may be physically drawn on the scale at selected numerical frequencies as desired. The card or plastic slide 10 may be provided with an identifying strip 18 on which notes may be written. The lines 16, 17 and notes should preferably be entered by lead pencils whose marks can be erased. The notes may be symbols which will identify a drawn line 16, so that the entries made by an operator may be concisely made on one readily read element, such as card or slide 10.

Figure 2:
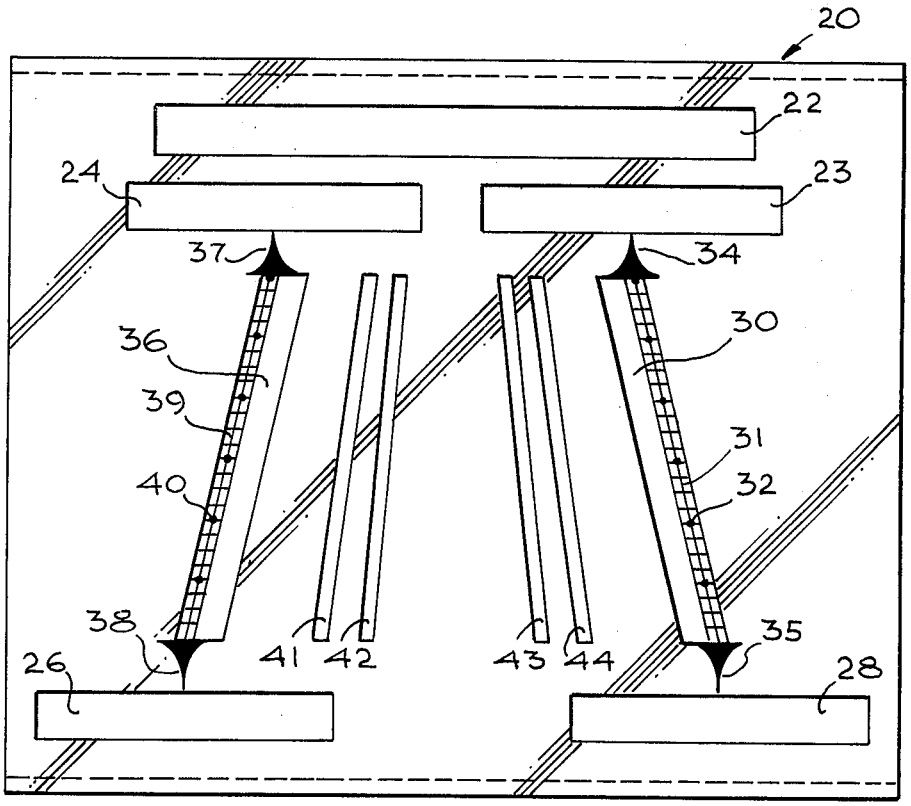
FIG. 2 illustrates a second part of an embodiment of the invention interworking with the part shown in FIG. 1.

FIG. 2 illustrates an overlay element for use in connection with the slide 10 of FIG. 1. Basic overlay element 20 is shown having transparent portions or windows 22, 23, 24, 26, 28, 30, 36. The transparent portions may be described as windows which may be portions cut-away from the overlay element 20 or may be portions which are filled with transparent material such as a clear plastic or glass. The overlay element 20 is designed to cooperate or work with the slide 10, so that the slide 10 may be moved horizontally to the right or to the left relative to the overlay element 20. It is envisioned that assembly 20 in most modes of operation will remain stationary during this operation.

The window 22 is designed to allow information on strip 18 of slide 10 to be seen therethrough. The windows 23 and 24 are designed to allow one viewing the overlay element 20, having the slide 10 underneath, to see the frequency graduations appearing on the upper frequency graduated scale 12. The windows 26, 28 are designed to allow the frequency graduations on graduated scale 14 to be seen therethrough by a viewer of the overlay element 20.

Window 30 is arranged so that lines, such as entered lines 16, 17 in FIG. 1 of the drawings, may be seen by the viewer therethrough. As seen in FIG. 2, window 30 is a slanted window whose upper edge is horizontally offset from its lower edge by a horizontal or lateral distance. Portions of the window 30 have graphical graduations made which are, except for the black lines, transparent also. The graphical graduations 31 are marked uniformly by a number of points 32. The number of points 32 correspond to the horizontal or lateral distance as calculated in the graduations of the slide 10 which the window 30 encompasses in its horizontal slant. The upper point 34 of window 30 is marked by a point indicator, as is the lower point 35. The upper point 34 is precisely 6.0 graduations horizontally offset from the lower point 35. Exactly six points 32 are marked in the graduations 31 found in the window 30. Thus, it may be appreciated that the graduations 31 act as a vernier scale for precisely locating a desired frequency within the range set by the upper point 34 and lower point 35.

Window 36 is likewise slanted, but in an opposite direction to window 30. Window 36 has a horizontal or lateral distance between its lower edge 38 and its upper edge 37 of exactly six frequency marks as determined by the frequency graduation found on slide 10. The upper edge 37 of window 36 is marked with a point indicator, as is the lower edge 38 marked with a point indicator. The point indicators can precisely position the overlay element 20 relative to the slide 10 whose graduated scales may be seen through the windows 24, 26. Again, the lateral distance between the bottom edge 38 and the upper edge 37 of the window 36 is six frequency units as determined by the graduated scales 12, 14 on slide 10. Window 36 is provided with graduations 39 which, like graduations 31, are transparent. Graduations 39 include six points 40 which are spaced equidistantly along the slanted edge of window 36. In such a manner, the graduations 39 act as a vernier scale so that a frequency between the frequency band defined by the upper edge 37 and lower edge 38 of the slanted window 36, can be located with greater precision.

In the mixer into which received signals and echoes are mixed with the oscillator frequency in a superheterodyne system, many harmonic and image response frequencies may coincide with the particular expected or targeted received frequency. Thus, any emittor which emits frequencies which might, when received by the receiver mixer system, produce a frequency which would coincide with the expected received frequency or echo, must be determined and neutralized for accurate receiver use. Windows such as windows 30, 36 must be arranged so that any interference frequency which is coincidental with such harmonic or image frequencies that, when channeled through the mixer might appear as the intended or targeted frequency, will be seen through these windows. Thus, additional windows 41, 42, 43, 44 must be cut in the basic assembly 20 so as to bracket between their horizontal slants such frequency ranges or bands. Moreover, each of the windows through which the interference frequency may be seen must be cut wide enough to represent the response band so that any interference frequency close enough to the expected or intended received signal or any harmonic or image thereof, which in any way might cause an interference of the expected frequency in the mixer or contribute to confusion of the expected frequency, will be identified when the apparatus is used.

The ungraduated portions of the windows 30 and 36 could provide additional range to isolate a response resulting from the second mixer or oscillator harmonic image responses unique to dual conversion receivers. In such use, the graduated portions 31 and 39 provide for identifying the fundamental and image responses of the receiver. The additional windows 41, 42, 43 and 44 provide for identification of harmonic responses characteristic of single and dual conversion type receivers.

Figure 3:
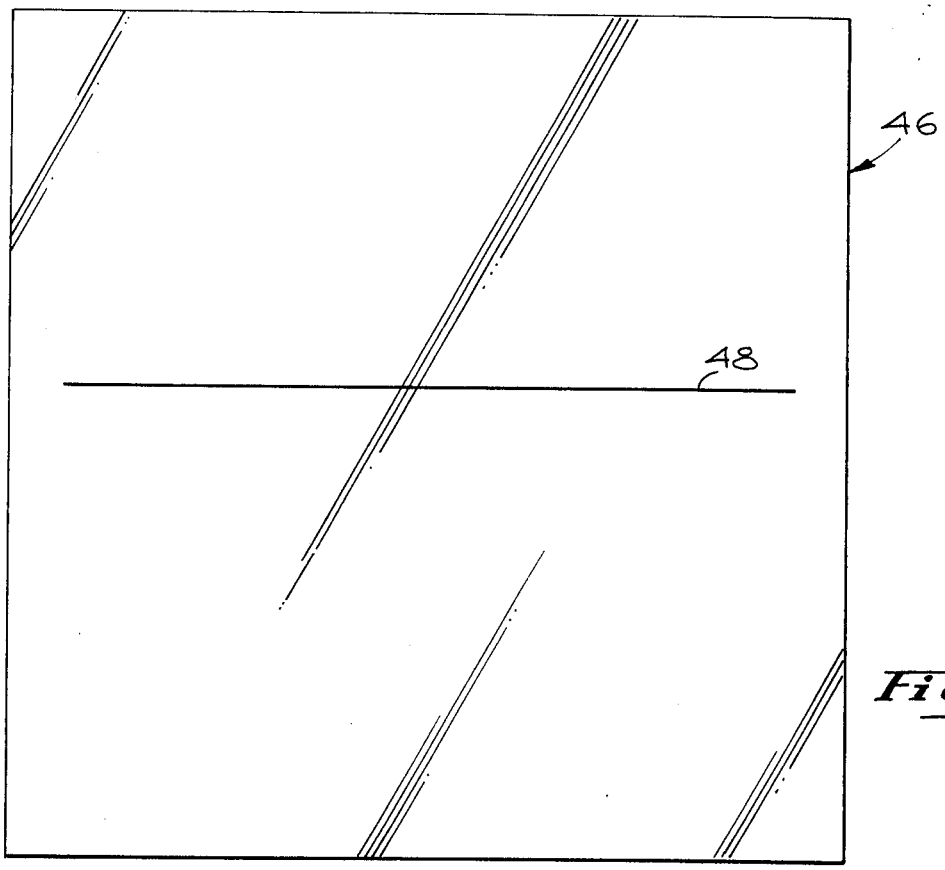
FIG. 3 illustrates a cursor interworkable with the elements of FIGS. 1 and 2 showing an embodiment of the invention.

FIG. 3 shows a cursor 46 which is designed to be positioned over and movable vertically relative to the overlay element 20 by suitable vertical guides of conventional construction (not shown) on either cursor 46 or assembly 20. The cursor 46 is marked with a distinct line 48. Otherwise, the cursor 46 should be completely transparent so that all of the elements viewable on the overlay element 20 having the slide 10 positioned thereunder may be seen by the calculator.

Figure 4:
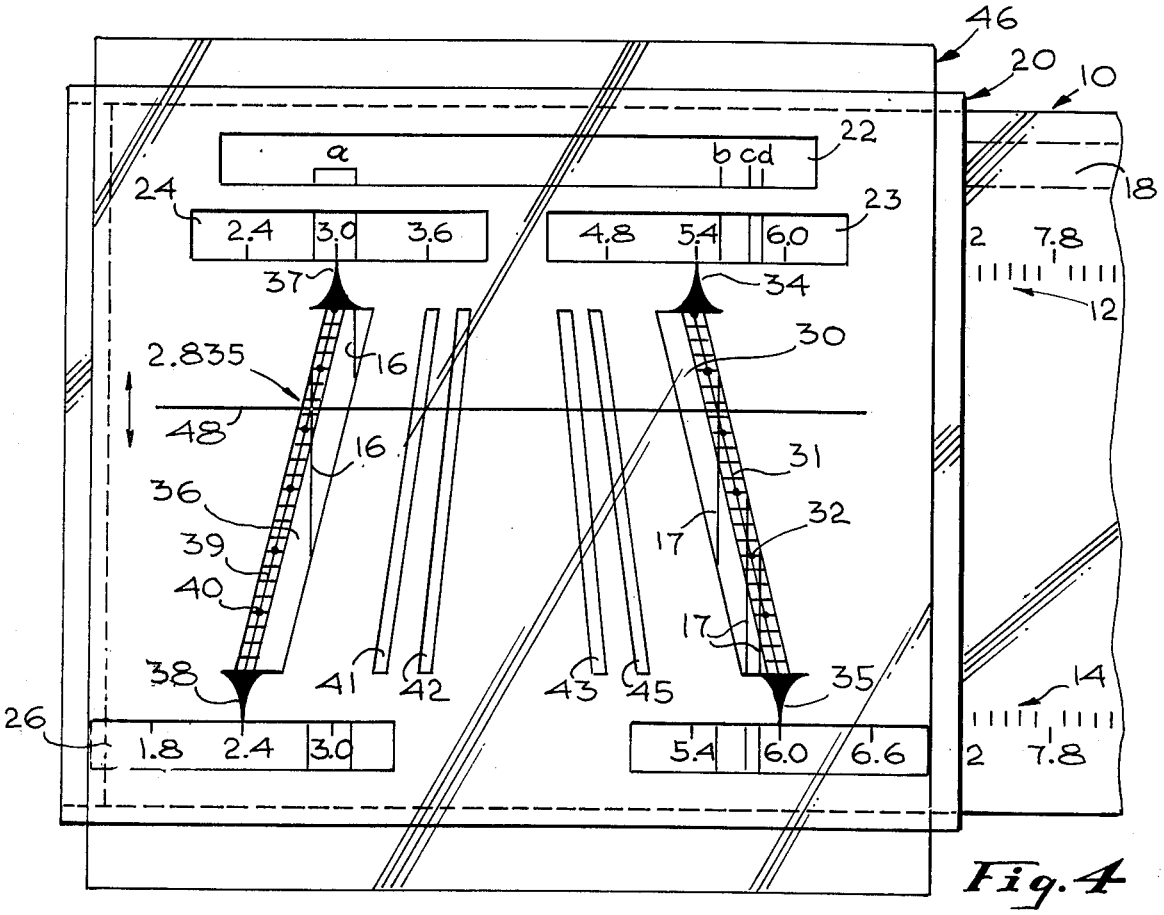
FIG. 4 illustrates the parts of FIGS. 1, 2 and 3 interworking with each other in an embodiment of the invention.

The entire assembly of the visual display apparatus is seen in FIG. 4 of the drawings in which slide 10 is shown slidably positioned under overlay element 20.

Markings made on the slide 10, such as lines 16, 17, can be seen through the windows 23, 24, 26, 28, 30, 36. Also, identification markings made on the strip 18 can be seen by the viewer through window 22. The transparent cursor 46, having its clearly identifiable line 48, is placed over the overlay element 20. The line 48 is placed so that it precisely coincides with the expected or targeted received frequency or, perhaps, echo using the vernier graphs 31, 39.

As may be appreciated, the slide or card 10 may be horizontally moved relative to the overlay element 20, so that one of various frequency ranges may encompass the frequency of the targeted received frequency as indicated by pointers or edges 34, 35 or indicated by pointers or edges 37,38.

In operation, the calculator user will enter by making lines such as lines 16, 17, the known potential interference frequencies that might be emitted on the graduated scale of slide 10. Identifying marks may be made on strip 18 so that the source or other identification of the thus entered lines 16, 17 on the slide 10 may be quickly referenced. Lines 16 in the specific embodiment shown in FIG. 1 represents a frequency agile radar having detectable frequencies whose values shift between these lines continuously.

A particular overlay element 20 having windows unique to the specific receiver system is placed in relationship with the slide 10, so that the slide 10 may be maneuvered horizontally relative thereto. Slide 10 is then moved horizontally so that the precise narrow band width of the expected or intended targeted received frequency is bracketed between the pointers 34, 35 or the pointers 36, 37 after alignment with the cardinal frequencies as seen through the windows 23 and 28 or 24 and 26.

The cursor 46 is then moved vertically so that its distinct black line 48 is positioned at the precise frequency which is expected to be received, referring to the vernier graduations 31 or 39. Line 48 then represents the target or echo frequency received. The distinct line 48 then intercepts or crosses the known potential interference frequency lines marked on the slide 10. When line 48 is coincidental with the interference frequency lines such as 16, 17 and a window such as windows 30, 36, a potential interference exists. At these lines of intersection, it can be instantly determined that a particular known interference frequency which is identified will potentially cause a spurious response, and thus possible interferences. The identification of the known interference frequency can be readily made by viewing the identification marks made on strip 18 viewable through the window 22. The known interference frequency may then be subjected to a form of emission control, such as the elimination of the emittor or the retuning of the emittor until there is no longer a crossover or intersection appearing in the windows 30, 36, 41, 42, 43, 44.

As may be appreciated, the particular window widths, heights and slants made in the basic overlay element 20 are determined by the specific characteristics of a specific receiver system. Each individual receiver, however, may have different local oscillator frequencies, so that by adjusting the receiver, different expected or intended target frequencies and different images and harmonics when applied through the mixer, will be expected. Whenever the expected target frequency is changed, the slide 10 may be repositioned accordingly.

In the particular example seen in FIG. 4 of the drawings, the intended targeted frequency is 2.835 on the frequency graduation scale. Thus, the upper pointer 37 of the window 36 is placed at the frequency graduation 3.0 on the upper scale 12, while the lower edge 38 of window 36 is placed along the lower frequency graduation scale 14 at the marking 2.4. The cursor line 48 is maneuvered along the vernier graduation or scale 39 until it is at the precise expected target frequency 2.835. The fundamental operating, image and harmonic frequency bands are arranged by virtue of the windows 36, 41, 42, 43, 44 and 30 so that any interference frequency can be determined by the intersection of the cursor line 48 with the interference frequency lines which have been drawn on the scale 10 are visible through these windows.

Summarizing, a method of identifying an emittor interference frequency coincidental with a receiver response targeted frequency includes the step of entering the identifying potentially interfering emittor frequencies on a frequency graduated scale having at least two parallel, horizontally disposed frequency graduated scales. Next, the transparent window is positioned on the two frequency graduated scales so that the user can see through the window the lines corresponding to the limited frequency response bands. The cursor identifying the expected received frequency, is then placed or positioned movably relative to the window. The potential interference frequency is identified by the interception of the cursor mark on the potentially known interference emittor frequencies identified by lines on the frequency graduated scale. Preferably, the windows will be slanted, and the upper and lower edges of the window will be positioned on the corresponding upper and lower frequency graduated scales at cardinal points bracketing the receiver response targeted frequency. The cursor and the window may be moved simultaneously to re-set the display, if desired.

If the intended target frequency is to be changed, not only must the slide 10 be maneuvered horizontally so that the correct frequency bands or ranges will be bracketed by the cardinal point indicators, but the cursor 46 must be maneuvered vertically so that the cursor line 48 will be precisely placed over the intended target frequency and its potential image and harmonic response as seen through the various known image and harmonic windows which have been arranged in the basic overlay element 20. As may be appreciated, the windows cut in the basic overlay element 20 will be unique to a specific or particular receiver system and its application. Thus, several different basic overlay elements 20 may be provided for use in combination with a single slide 10 and a single cursor 46. When different receiver systems or techniques are used, a different basic assembly constructed according to the unique characteristics of the different receiver then can be substituted for the basic overlay element 20.

Figure 5:
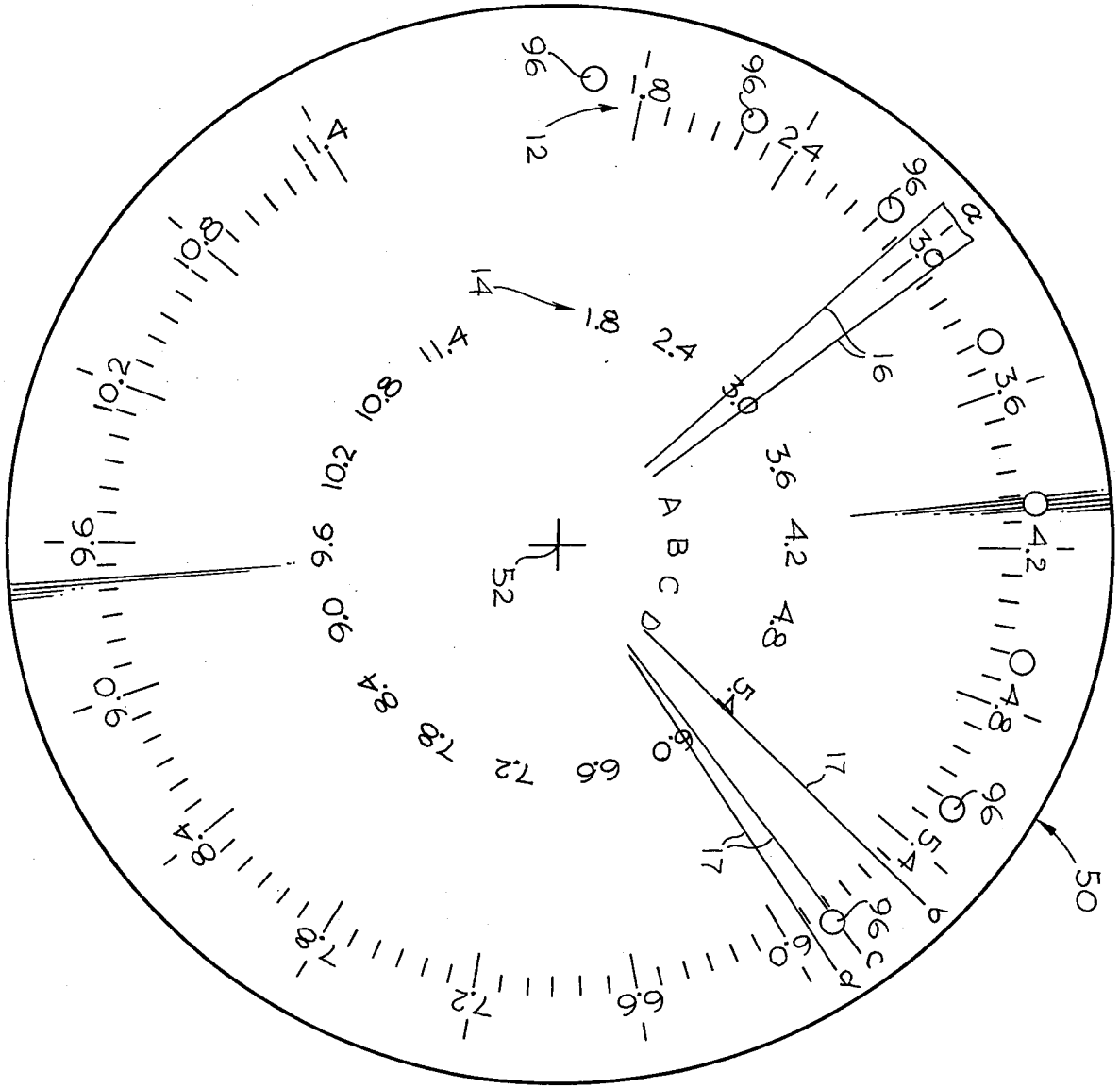
FIG. 5 illustrates a graduated scale device in a circular pattern in a second embodiment of the invention.
Figure 6:
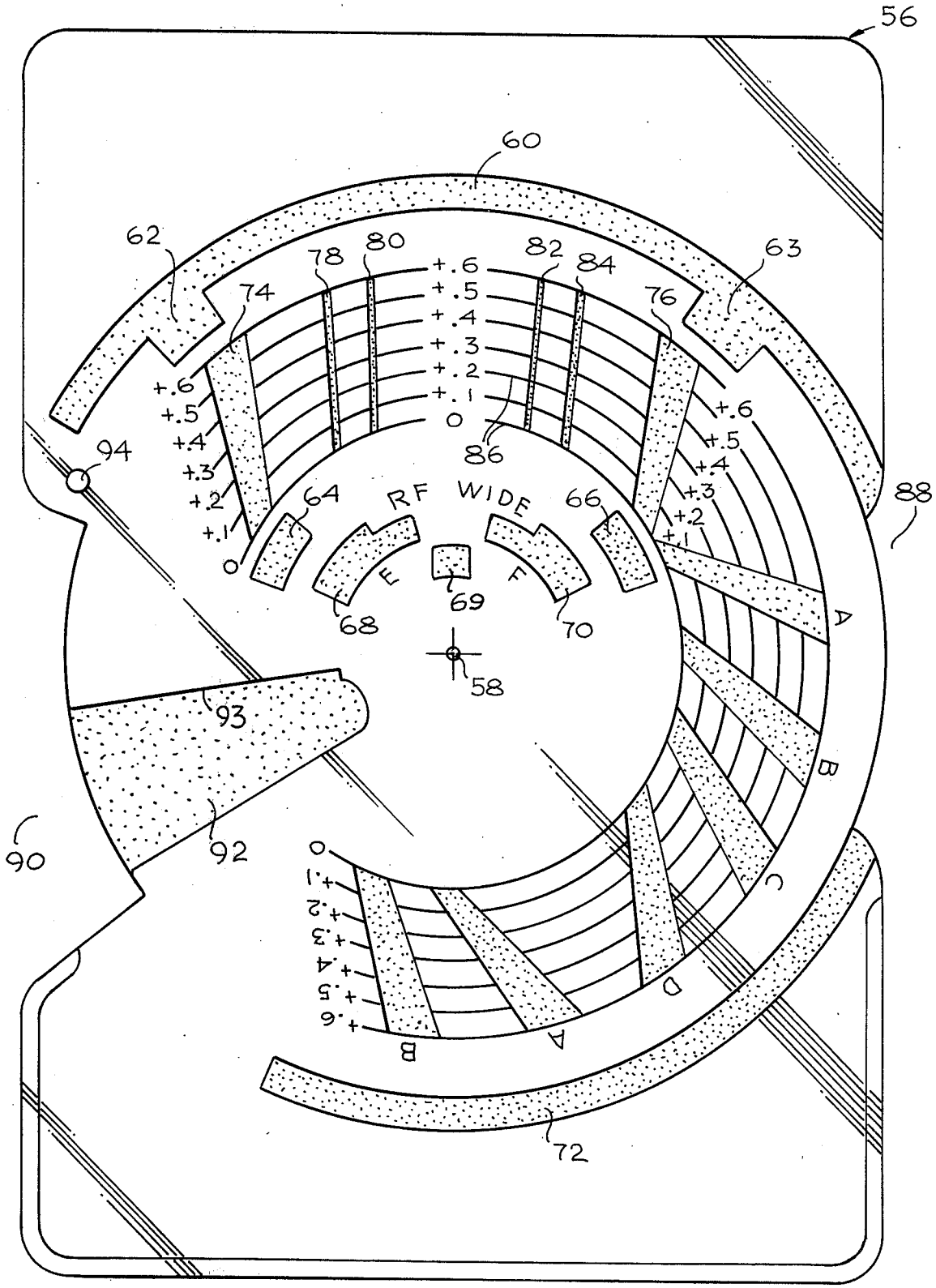
FIG. 6 illustrates a partially transparent device for interworking with the part shown in FIG. 5 in the second embodiment of the invention.
Figure 7:
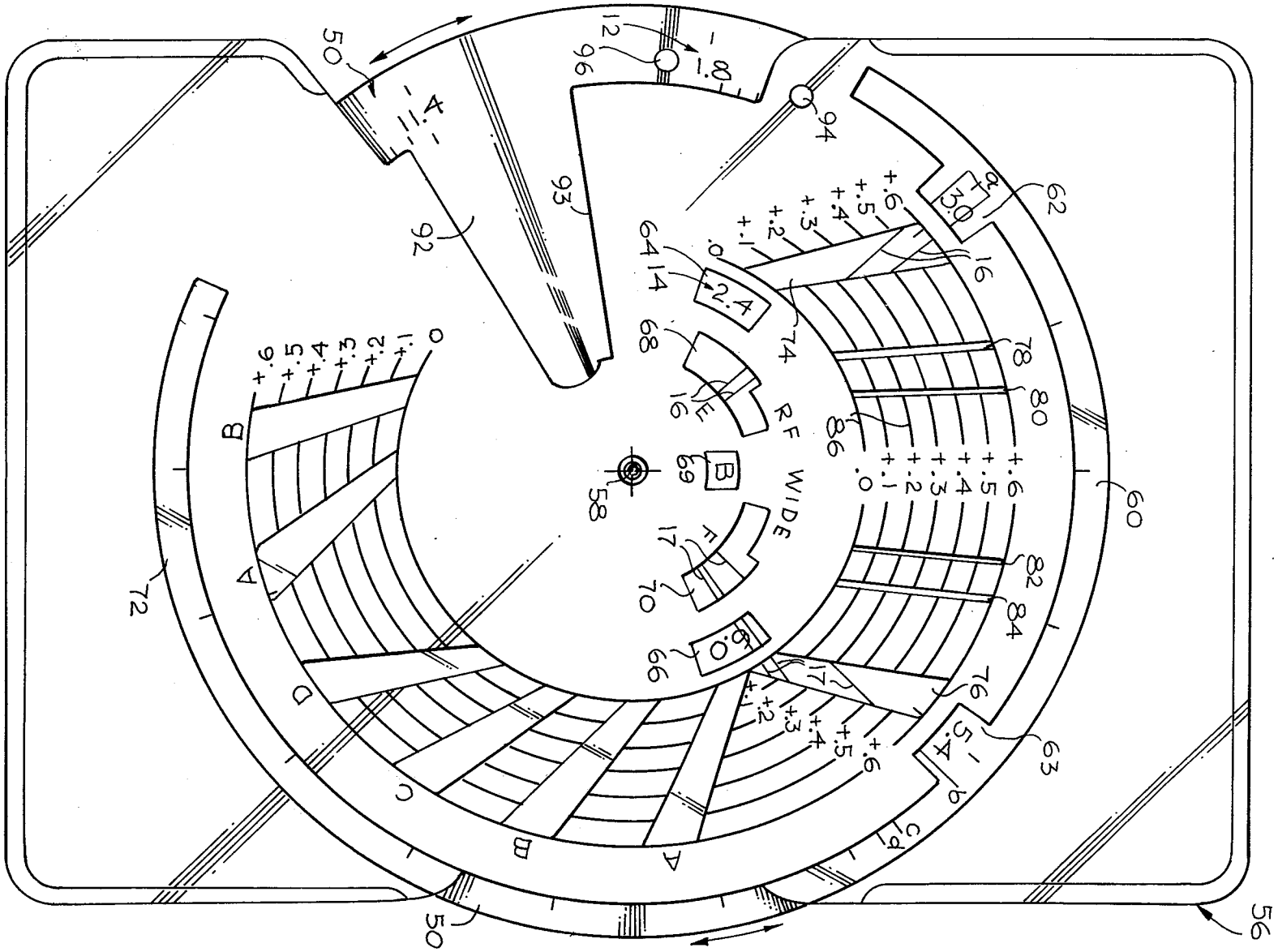
FIG. 7 illustrates the parts of FIGS. 5 and 6 interworking with each other in the alternative embodiment of the invention.

Referring now to FIGS. 5, 6 and 7, an alternative embodiment of the invention can be seen. The scales 12, 14 of FIG. 1 are seen in FIG. 5 arranged on a circular disk 50. Lines 16 are entered at the appropriate points along the graduated scales to represent a frequency agile radar whose detectable frequency values shift between the lines continuously. Similar also to FIG. 1, lines 17 represent other known potential interference frequencies which might be emitted. The lines are preferably made by some instrument such as a pencil with their origin in the center of the disk 50, so that the lines may be removed and different lines may be entered for a different calculation. The lines can be entered using a straight-edge which will be explained in more detail. Space is provided above the frequency indicia so that short notations relating to the various entries such as line 16, 17, may be made by the calculator. The circular disk 50 has a center 52.

A basic overlay element 56 having a center 58 is designed for assembly with the circular slide 50. Overlay element 56 has a concentric window 60 with radially extended transparent window portions 62 and 63. Windows 64, 66, 68 and 70 are provided concentric with the center 58, for purposes that will be described in more detail below. Additionally, concentric window 72 is provided along the overlay element 56 opposite the center 58 from concentric window 60.

Transparent windows 74, 76 are off-set from a radial line so that a circumferential distance is passed between the lower points of these windows, and their corresponding upper points. Additional slotted windows 78, 80, 82 and 84 are also provided. Additionally, generally radial but slightly angled from the radial are slot windows marked A, B, C, D, A and B, for purposes that will be described in more detail below. Concentric window graduations 86 are marked to provide a vernier for reading from the windows, as will be explained below. Cut-out portions 88 and 90 are provided on the right and the left hand sides of the overlay element 56. A cut-out portion 92 is provided having a straight-edge 93 and sufficient room therewithin for maneuvering a pencil or other marking device.

The circular slide 50 has its center placed coincidentally with the center 58 of the overlay element 56, note FIG. 7. An axle, not shown, is provided so that the circular slide 50 may be maneuvered about its center 52 relative to the overlay element 56. Fingers may move the circular slide 50 which protrudes through the cut-out portions 88, 90. The upper graduated scale 12 can be seen through the window extensions 62, 63. The lower graduated frequency scale 14 can be seen through the windows 64, 66. Identifying indicia for the various markings can be made at the outer periphery of the circular scale 50, and seen by the manipulator through the concentric windows 60, 72.

Circular slide 50 is then maneuvered so that the expected or intended targeted received frequency is bracketed between frequencies showing through the windows 64 and 62, or between windows 66 and 63. The known potential interference frequencies which are within the bracketed frequencies will appear through the transparent windows 74, 76, 78, 80, 82 and 84. The precise target frequency which is expected to be received can be determined by reference to the graduated concentric markings 86, which will act as a vernier scale similar to the vernier graduations in FIGS. 2 and 4 in the previously explained embodiment. By extrapolation from the graduated concentric lines 86, the potential interference frequencies can be precisely identified and corrective actions can be taken before radar use.

After use, the circular slide 50 can be rotated so that the markings will appear in the opening 92. The markings which are no longer desired can be removed and new markings placed therein, using the straight-edge 93 if desired. In this alternative embodiment, it can be appreciated that only two interworking, moving parts are required. The parts can be movably joined together at their centers 52, 58. If the slide 50 and overlay element 56 are made small enough, the entire arrangement can be placed and carried in pockets, and the device can be maneuvered with one experienced hand.

As an additional aid in aligning the various frequency graduations of the circular scale 50 relative to the transparent window slot arrangements of the overlay element 56, an index alignment hole 94 can be provided on the face of the overlay element 56. In a concentric circumferential line having a radial distance equal to the radial distance of index hole 94, a series of index holes 96 can be formed on circular slide 50. Thus, when the slide 50 is turned about its center 52 to an approximate correct position relative to the overlay element 56, a pencil or other tubular type instrument can be inserted through index hole 94 and through the slide hole 96 appearing approximately underneath. By working the pencil, it can be appreciated that the slide 50 will be maneuvered relative to the overlay element 56 for precise alignment to permit a more accurate positioning of the cardinal frequencies within the windows as desired.

Window slots A, B, C, D, A and B represent new responses of a particular subject receiver, and may be made at various locations around the partially transparent overlay element 56 in order to present those image and harmonic responses which might potentially interfere with the targeted frequency to be received in the radar system. Selection among the window slots A, B, C and D may be made by reference to the window 69. For example, if the letter "B" shows through the window 69 (FIG. 7), only the B window slot need be examined and the adjacent slots A, C, and D may be ignored.

In such manner, the ready and quick identification of interference frequencies caused by known sources can be identified for a plurality of expected or intended received frequencies from a single receiver system utilizing a single apparatus as described above. Simple substitution of basic overlay element 20 can be made for the ready and quick identification of interference frequencies when different receiver systems are used.

Although there have been described above specific arrangements of a receiver interference frequency identification visual display apparatus and methods of operating same in accordance with the invention for the purpose of illustrating the manner in which the invention may be used to advantage, it will be appreciated that the invention is not limited to these specific arrangements, or to the specific method steps outlined. Accordingly, any and all modifications, variations or equivalent arrangements or methods which may occur to those skilled in the art should be considered to be within the scope of the invention as defined in the appended claims.

What is claimed is:

1. A calculator for displaying a receiver response to distinguish between a desired receiver response frequency and an undesirable interference frequency, said calculator comprising:

a first circular disk rotatable about its center, said first disk having a first graduated frequency scale and numerals disposed thereon in a circular path and adjacent the outer periphery of said disk and a second graduated frequency scale disposed thereon along a circular path, said circular paths being concentric to each other and to the center of said disk, said second graduated scale being disposed closer to the center of said disk, and radial straight lines on said first disk originating from the center thereof and indicating interference frequencies; and a second disk rotatable about the center of said first disk and having a center, said second disk having a first arcuate window disposed concentric with the centers of said disks and adjacent to the periphery of said first disk for exhibiting therethrough limited frequency response bands on said first graduated scale and second and a third arcuate windows on said second disk and disposed for exhibiting therethrough a limited frequency response of said second scale, said first window and said second and third windows being concentric to each other, a first set of elongated windows having straight edges in the long direction and extending between said first arcuate window and said second and third arcuate windows and being offset from the center of rotation of said disks for exhibiting therethrough portions of one or more of said radial lines, a second set of arcuate windows concentric with said first, second and third arcuate windows and disposed closer to the center of said disks than said second and third arcuate windows for exhibiting therethrough portions of said radial lines, said first arcuate window having radially, inwardly extended window portions thereon for exhibiting therethrough numerals on said first scale.

2. A calculator as defined in claim 1 wherein each of said offset, elongated windows is aligned at its lower edge with one of said second and third arcuate windows for exposing a portion of said second graduated scale and at its upper edge with one of said radially extended window portions.

3. A calculator as defined in claim 2 wherein said second disk is provided with a third set of elongated, off-set windows disposed generally between said first window and a circle passing through said second and third windows for displaying different portions of said radial lines, and wherein a further window is provided closer to the center of said disks than said other windows for exhibiting markings provided on said first disk corresponding with markings on said second disk provided adjacent said third set of windows.

4. A calculator is defined in claim 1 wherein the additional opening is provided on said second disk forming at least one straight edge extending radially with respect to the center of said disks for drawing on said first disk radial lines representing additional interference frequencies.

* * * * *